United States Patent [19]

Amoroso

[11] 4,068,897

[45] Jan. 17, 1978

[54] REPLACEABLE CUTTING BIT HOLDER ASSEMBLY

[75] Inventor: Michael J. Amoroso, Marion, Ill.

[73] Assignee: M.A.T. Industries, Inc., West Frankfort, Ill.

[21] Appl. No.: 734,997

[22] Filed: Oct. 22, 1976

[51] Int. Cl.[2] ..... E21C 35/18

[52] U.S. Cl. ..... 299/91; 175/413; 299/89

[58] Field of Search ..... 299/89, 90, 91–93, 299/39, 41; 175/413; 404/121

[56] References Cited

U.S. PATENT DOCUMENTS

| | | | |
|---|---|---|---|
| Re. 28,310 | 1/1975 | Krekeler | 299/93 |
| 322,567 | 7/1885 | Stonesifer | 404/121 X |
| 2,083,834 | 6/1937 | Galuppo et al. | 299/93 X |
| 3,101,932 | 8/1963 | Wright | 299/89 X |

*Primary Examiner*—Ernest R. Purser

*Attorney, Agent, or Firm*—Cohn, Powell & Hind

[57] ABSTRACT

This bit holder assembly includes an elongate base member, which is fixedly attached to a mining machine cutter, and a bit-holding block member, which is connected to the base member by means of longitudinally spaced fasteners. The block member and base member each include interface portions engageable when the members are connected. The assembly can be modified to suit different types of cutting bits and the thickness of the base member can be chosen to achieve the correct mounting height for the particular bit used.

8 Claims, 15 Drawing Figures

REPLACEABLE CUTTING BIT HOLDER ASSEMBLY

BACKGROUND OF THE INVENTION

This invention relates generally to a replaceable cutting bit holder assembly and particularly to an assembly having a fixed base member to which a removable tool holding block is attached.

For many years the conventional method of attaching cutting bits to the cutters of continuous mining machinery was to provide bit holding blocks which are directly welded to the mining machine cutters. Consequently, replacement of such tool holders required the use of a cutting torch handled by an experienced welder. Because of the difficulties in finding suitably qualified welders, and because of the problems encountered in welding in the face area of a coal mine such blocks, and therefore the associated bits, were simply not replaced and the machines were operated with a decreased number of bits. The result of this was that adjacent bits became overloaded and the remaining bits and blocks suffered progressively increasing wear, until such time as the entire cutter of the machine had to be replaced with a new cutter and the old one sent out for repair.

In those instances in which an attempt was made to replace the worn bit blocks by welding new ones in position, the attack angle of the bits was frequently out of alignment because of errors in positioning the blocks.

Because of the inadequacies of the above system, replaceable tool holders have been devised which provide a separate tool holding lug or block member removably attachable to a base member, the base member being fixedly attached to the mining machine cutter. An example of a replaceable tool holder is disclosed in U.S. re-issue Pat. No. 28,310. This holder consists essentially of a block member connected to a base member by means of a transverse pin. One of the two connected members is bifurcated to receive the other of said members and the transverse pin connects the two members together in double shear. In principle, the damaged member block is replaced by simply removing the pin connecting the block member to the base member. Unfortunately, because the base includes outstanding portions, such portions also tend to become damaged with the result that proper repair of the assembly in some instances requires replacement of the base members in addition to replacement of the bit-holding block members attached thereto.

The problems inherent in the tool holder assemblies discussed above have been solved by the present device in a manner which is neither disclosed nor suggested in the prior art.

SUMMARY OF THE INVENTION

This cutting bit holder assembly includes a base member, fixedly attached to a mining machine cutter, and a bit-holding block member removably attached to said base member by fasteners.

Each of said base and block members includes elongate sides extending generally in the direction of travel and face means extending between said sides, and the block member is connected to the base member by fastener means extending between said face means.

The fastener means includes a pair of longitudinally spaced bolts extending through openings provided in the block member and received within threaded openings provided in the base member.

The average thickness of the base member below the face means can be adapted to suit cutting bits of various kinds.

In a modified structure, the block and base are overlappingly related tending to preclude outward separation of said ends.

Another modified structure provides dowel means extending between said face means and providing a shear transfer means between said base member and said block member.

DESCRIPTION OF THE PREFERRED EMBODIMENT

Figure 2:
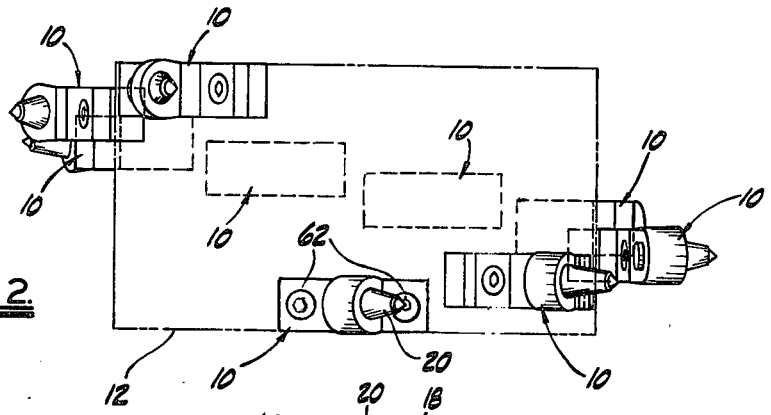
FIG. 2 is a plan view of a typical tool arrangement on the drum cutter.
Figure 1:
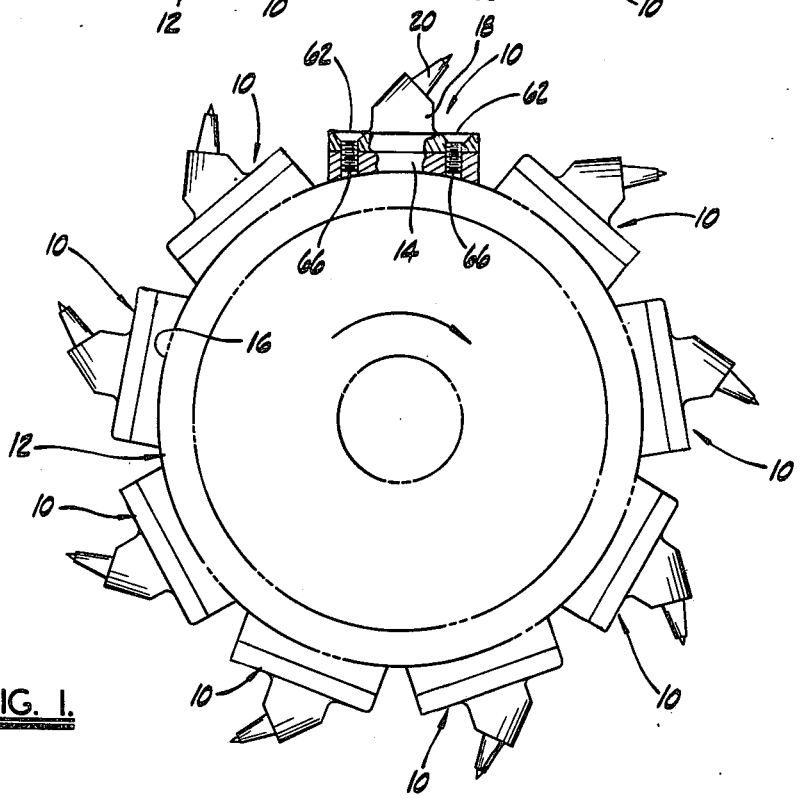
FIG. 1 is an elevational view of a continuous miner drum cutter having a plurality of bit holder assemblies attached thereto.

Referring now by reference numerals to the drawings and first to FIG. 1, it will be understood that a plurality of cutting bit holder assemblies, indicated by numeral 10, are circumferentially disposed about a mining machine drum cutter 12. Each assembly 10 includes a base member 14 fixedly attached as by welding to the drum surface 16 and a bit-holding block member 18, which is removably connected to the base member 14 and provides a holder for a cutting bit of the type generally indicated by numeral 20. As shown diagrammatically in FIG. 2, the base members are typically arranged in a helical formation.

Figure 4:
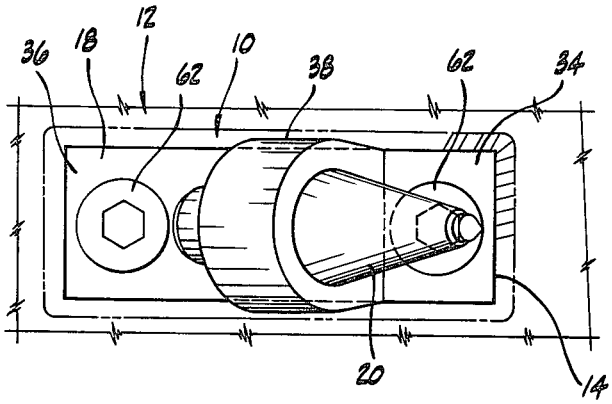
FIG. 4 is a plan view of said assembly.
Figure 3:
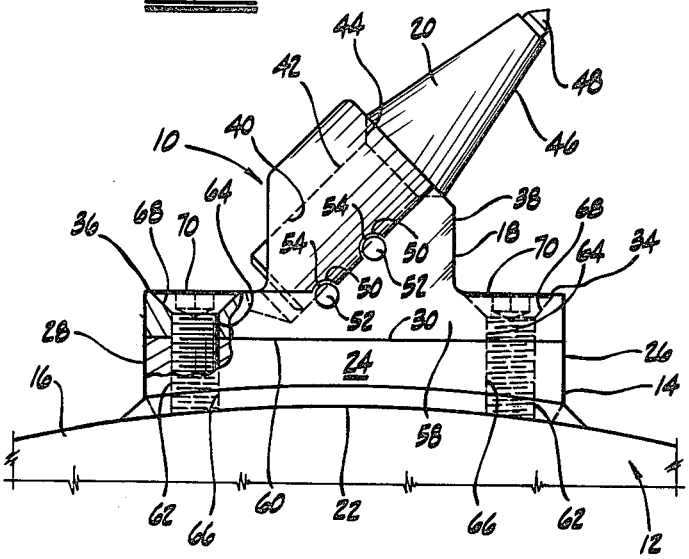
FIG. 3. is an enlarged, side elevational view of a bit holder assembly.
Figure 5:
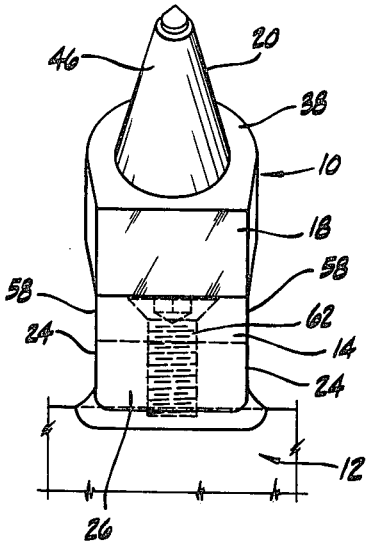
FIG. 5 is a front elevational view of said assembly.
Figure 7:
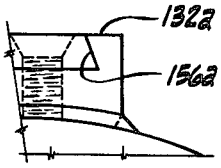
FIG. 7 is a fragmentary detail of an alternative form of the assembly of FIG. 6

The details of the cutting bit holder assembly are best understood by reference to enlarged FIGS. 3, 4 and 5. As shown in FIG. 3 the base member 14 is elongate and includes a lower face 22 which is arcuate, or otherwise suitably configurated, to permit the attachment of the sides 24 and the front and rear portions 26 and 28 to the drum surface 16, as by welding. The upper portion of the base member 14 includes a substantially flat surface 30 which extends between the sides 24 and constitutes a face means. It will be understood that the thickness of the base member 14 below the surface 30 is adapted to suit the particular bit used to ensure that the correct bit height is achieved. The block member 18 includes front and rear portions 34 and 36 and an intermediate portion 38. The intermediate portion 38 is provided with an inclined passage 40, which receives the shank 42 of the bit 20, and passage 40 including an enlarged portion 44 at the outer end receiving the head 46 of the bit 20 in abuting relation. The bit head 46 includes a hardened tip 48, and the shank 42 is provided with circumferential grooves 50 which receive transversely disposed retaining pins 52, which pass through compatible passages 54 formed in the block member intermediate portion 38 and are removable when it is desired to replace the bit 20. The lower portion of the block member 18 includes a widthwise extending, substantially flat surface 60 which extends between the sides 58 of said block member and constitutes a face means, the surface 60 of the block member 18 being compatibly formed to engage with the corresponding surface 30 of the base member 14 and providing a seating means therefor.

The connection means between the block member 18 and the base member 14 consists essentially of two bolts 62 having countersunk heads, as shown, or non-recessed regular heads. The bolts 62 are longitudinally spaced from each other in the direction of travel of the bit 20. Suitably configurated openings 64 are provided in the block member 18 to receive said bolts therethrough and threaded openings 66 are provided in base member 14 in register with said openings 64. The compatible configuration of the openings 64 provides an effective recess for the heads of the bolts 62. If necessary, the bolts 62 are coated with nylon or an epoxy resin to prevent the loosening of said bolts resulting from vibration, thereby insuring that the engagement between the flat surfaces 30 and 60 of the base member 14 and the block member 18 is maintained.

It will readily be understood that the forces acting on the bit 20 during the operation of the mining machine result in an uplift component, which tends to separate the block member from the base member, and a shear component, which tends to slide the surfaces 30 and 60 relative to each other. Both of these components are resisted by the bolts 62. The uplift by the threaded engagement between the bolts and the base member, and the shear by the cross sectional area of the bolts.

FIGS. 6–13 disclose modifications of the device shown in FIGS. 3–5. The modifications relate to the means by which the block member and base member are held together and it will be understood that in other respects the devices are essentially the same as described in FIGS. 3–5.

Figure 6:
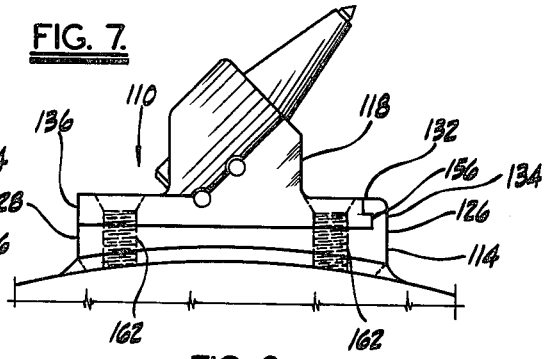
FIG. 6 is a reduced side elevational view of modified assembly.

The device 110 disclosed in FIG. 6 includes a block member 118 connected to a base member 114 by bolts 162. Thebase member front portion 126 includes a re-entrantly formed retaining portion 132, which extends the width of the base member and engages a compatible stepped portion 156 provided on the block member 118.

The primary attachment of the block member 118 to the base member 120 is by fasteners 162. Additional resistance to uplift is provided by the overlapping relationship between the base member re-entrant portion 132 and block member stepped portion 156. In addition, the base member front portion 126 protects the block member 118 and tends to reduce the shear forces on the bolts 162.

It will be understood that the provision of overlapping portions 132 at each end rather than one end, can be provided to further assist in transferring forces, which are received by the bit 120, from the block member 118 to the base member 114. It will also be understood that the dovetail overlap disclosed in FIG. 7 and indicated by **132*a* can be substituted for the stepped overlap disclosed in FIG. 6**.

Figure 8:
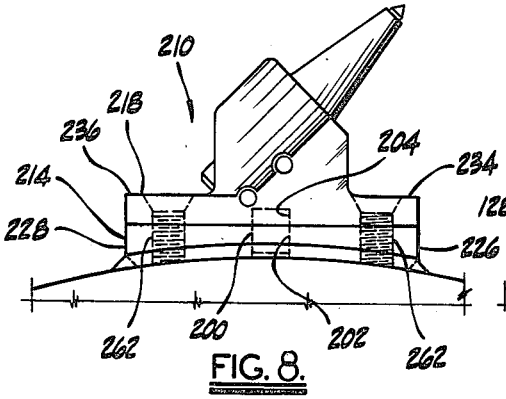
FIG. 8 is a reduced side elevational view of another modified assembly.

The device 210 disclosed in FIG. 8 includes a block member 218 connected to a base member 214 by bolts 262. As shown, no overlap is provided between the base member front and rear portions 226 and 228 and the corresponding block member portions and uplift resistance is provided by the threaded interconnection between the fasteners 262 and the block member 214. In those instances in which additional shear transfer capability is desired, a dowel or key indicated by numeral 200 is provided. The dowel 200 is disposed intermediate the bolts 262 and suitable dowel-receiving openings 202 and 204 are provided in the base member 214 and the block member 218 respectively, and located on the longitudinal axis defined by the center of said bolts. As will be readily understood, the dowel provides an additional alignment feature.

Figure 9:
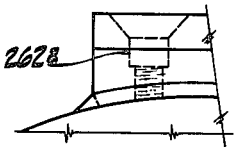
FIG. 9 is a fragmentary detail of an alternative form of the assembly of FIG. 8.

FIG. 9 illustrated the use of shoulder bolts indicated by **262*a***. These bolts, in effect, act as dowels as well as fasteners and provide increased shear resistance.

Figure 10:
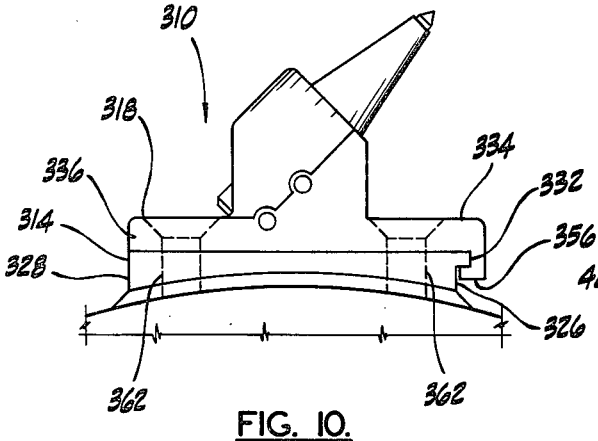
FIGS. 10–12 are reduced side elevational views of other modified assemblies.

The device 310 disclosed in FIG. 10 includes a block member 318 connected to a base member 314 by bolts 362. The base member front portion 326 includes a retaining lip 332 and the block member front portion 334 includes a re-entrantly formed portion 356 which engages the lip 332 in overlapping relation. This arrangement provides additional resistance against uplift and also tends to reduce shear forces on the bolts 362.

Figure 11:
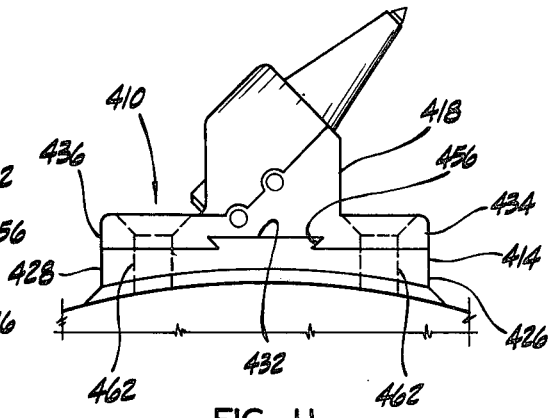

The device 410 disclosed in FIG. 11 includes a block member 418 connected to a base member 414 by bolt 462. The base member 414 includes a widthwise extending dovetail tongue 432 formed intermediate the front and rear portions 426 and 428, and received within a compatibly configurated groove 456 formed in the block member 418 intermediate the front and rear portions 434 and 436. The tongue and groove relationship resists uplift and also tends to reduce shear forces on the bolts 462.

Figure 12:
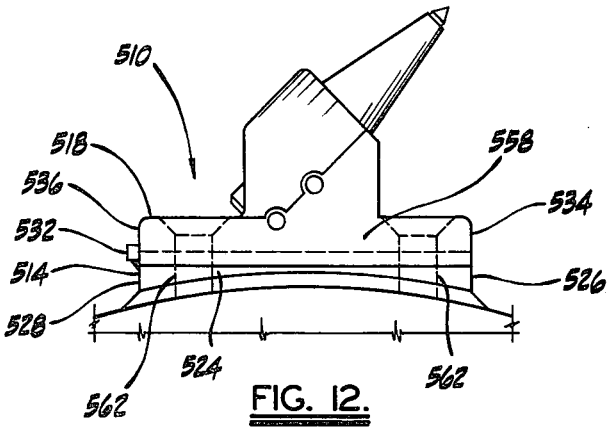
Figure 13:
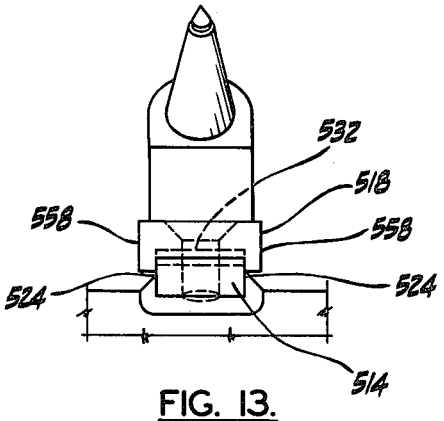
FIG. 13 is a front elevational view of the assembly of FIG. 12.

The device disclosed in FIGS. 12 and 13 includes a block member 518 connected to a base member 514 by bolts 562. The width of the block member 518 is greater than the width of the base member 514 to provide depending side portions 558 which overlap the sides 524 of the base member 514 and provide additional resistance to transverse shear forces. A stop 532 extending widthwise of the base member 514 and welded to the rear portion 528 thereof provides additional resistance to longitudinal shear forces.

Figure 14:
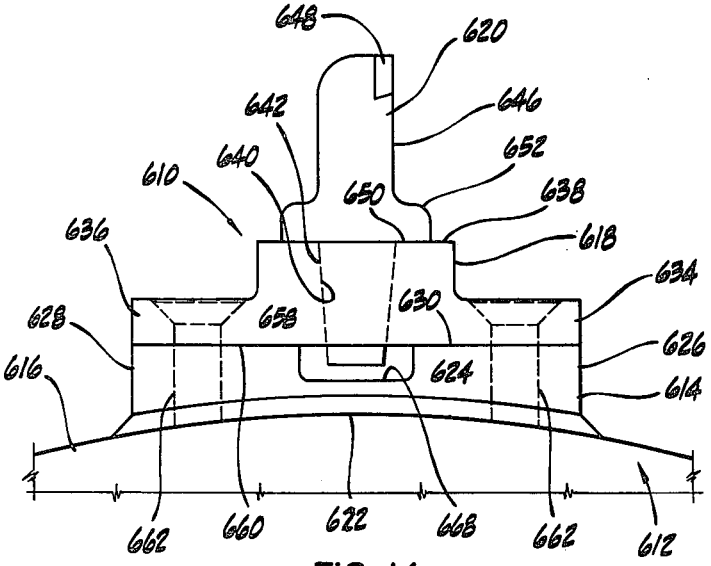
FIG. 14 is an enlarged side elevational view of an assembly adapted to suit a different type of cutting bit.
Figure 15:
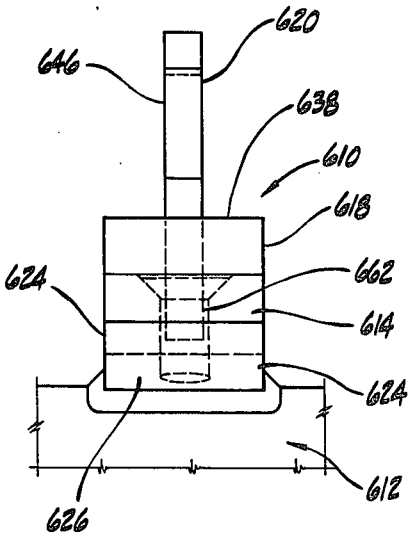
FIG. 15 is a front elevational view of the assembly of FIG. 14.

FIGS. 14 and 15 illustrate a device 610, which is modified to suit a different type of cutting bit indicated by numeral 620. As shown in FIG. 14, the base member 614 is elongate and includes a lower face 622 configurated for attachment of the sides 624 and the front and rear portions 626 and 628 to a drum surface 616. The upper portion of the base member 614 is adapted to suit the particular bit used and includes a widthwise extending, bit-receiving recess 668. The block member 618 includes front and rear portions 634 and 636 and an intermediate portion 638. The intermediate portion is provided with a passage 640, which is compatibly configurated to receive the tapered shank 642 of the bit 620 in wedge relation. The bit 620 includes a head 646 having a hardened tip 648 and a relatively wide shoulder portion 652, which is engageable with the flat upper face 650 of the block member intermediate portion 638. The lower end of the bit shank 642 extends into the recess 668 provided in the base member 614 and the bit 620 is removed by inserting a tool (not shown) into said recess below the end of the shank 642 and applying leverage thereto. The lower portion of the block member 618 includes a widthwise extending, substantially flat surface 660 which extends between the sides 658 of said block member and is compatibly formed to engage with and seat the base member upper surface 630.

As with the device disclosed in FIGS. 3–5, the connection means between the block member 618 and the base member 614 consists essentially of countersunk head bolts 662 longitudinally spaced from each other in the direction of travel of the bit. The bolts 662 are received through openings 664 provided in the block member 618 and are threadedly received within openings 666 provided in the base member 614 in register with block member openings.

It will be observed that except for tool receiving recess 668, the base member 614 is substantially similar to that disclosed for the device shown in FIGS. 3–5 and that the block member 618 is substantially similar except for the bit mounting. It will therefore be readily understood that the device can be adapted to suit a variety of cutting bits by suitable modification. In addition, the connection features discussed above with respect to FIGS. 6–13 which provide additional resistance to uplift and shear are generally applicable to the modified device disclosed in FIGS. 14 and 15.

The removal and replacement of the bit-holding block members from the associated base members is equally simple for all of the species described because the primary connection is provided by the bolts. When wear of the block member requires replacement thereof, it is a simple matter of removing the bolts aligning a replacement block member and inserting and tightening the bolts. Not only is the replacement procedure extremely simple but the utilization of bolts provides that alignment is automatic. Moreover, structural arrangement of parts between the block member and the base member does not require side plates having a fastener extending therethrough. Thus, the overall width of the assembly can be relatively narrow without loss of strength.

I claim as my invention:

1. A replaceable cutting bit holder assembly for a mining machine of the type having a movable cutter member, said assembly comprising:

a. an elongate base means fixedly attachable to the cutter member and including opposed sides extending longitudinally generally in the direction of travel and having seating means, b. an elongate bit-holding block means including opposed sides extending longitudinally generally in the direction of travel and having means engageable with said seating means, and c. a pair of longitudinally spaced threaded fastener means received through and connecting said block means to said base means and tending to urge said block means toward said cutter member.

2. An assembly a defined in claim 1, in which:

d. the base means includes substantially flat face means extending between said sides and providing said seating means, and said block means includes substantially flat face means extending between said sides and providing the means engageable with said seating means, and e. the flat face means of said bit block means protectively covers a sutstantial portion of the flat face means of said base means.

3. An assembly as defined in claim 1, in which:

d. the block means includes a pair of longitudinally spaced countersunk openings, e. the base means includes a pair of longitudinally spaced threaded openings in register with said block openings, and f. the threaded fastener means includes a pair of bolts received through said block openings in countersunk relation and threadedly received within said base openings, and g. the seating means and the means engaging the seating means include substantially coterminous planar portions extending between the longitudinal sides of the bit block means and the base means.

4. An assembly as defined in claim 1, in which:

d. the base means and block means each include opposed front and rear transversely extending portions and the front portion of one of said means is re-entrantly formed to overlappingly engage the front portion of the other of said means, tending to preclude outward separation of said overlapped portions.

5. An assembly as defined in claim 2, in which:

f. the base means and the block means each include a transversely extending front portion and the front portion of the base means is re-entrantly formed to overlappingly engage the front portion of the block means above said face means tending to preclude outward separation of said front portions.

6. An assembly as defined in claim 2, in which:

f. dowel means extends across said face means in the direction of the cutter means and provides a single shear transfer means between said block means and said base means.

7. A cutter member for a continuous mining machine comprising:

a. a rotatable drum having a curved upper surface, b. a plurality of elongate base members having the length thereof disposed generally circumferentially about said drum and being fixedly attached to the upper surface thereof said base members having a widthwise extending, substantially flat face means and said base members including a pair of longitudinally spaced threaded openings, c. a plurality of elongate bit-holding block members each including a lower widthwise extending substantially flat face means engageable with the face means of an associated base member, said block members including a pair of longitudinally spaced openings in register with corresponding openings in said base members, and d. a plurality of pairs of threaded fasteners received through the block openings and extending across the engaging face means toward the drum for threaded connection within the openings of associated base members to connect said block members to said base members in removable relation.

8. A cutter as defined in claim 7, in which:

e. each of said base members includes a transversely extending re-entrantly formed portion to overlap its associated block member in engaging relation at least at the front end thereof to resist outward movement of said end in a direction away from said drum.

* * * * *